US006248043B1

(12) United States Patent
Morton

(10) Patent No.: US 6,248,043 B1
(45) Date of Patent: Jun. 19, 2001

(54) FACIAL EXERCISE DEVICE WITH ADJUSTMENT FOR VARIABLE RESISTANCE

(76) Inventor: B. J. Morton, 6549 Mission Gorge Rd. # 408, San Diego, CA (US) 92120

( * ) Notice: Subject to any disclaimer, the term of this patent is extended or adjusted under 35 U.S.C. 154(b) by 0 days.

(21) Appl. No.: 09/233,297

(22) Filed: Jan. 19, 1999

Related U.S. Application Data

(63) Continuation-in-part of application No. 08/425,599, filed on May 19, 1995, now abandoned.

(51) Int. Cl.[7] ..... A63B 21/02; A63B 23/03
(52) U.S. Cl. ..... 482/11; 482/124; 601/38
(58) Field of Search ..... 482/122, 124, 482/125, 10, 11, 121, 148; 601/23, 38; 602/74, 75, 77; 606/204.35; 128/848, 857; 2/171.2, 171.4, 171.5, 200.2, 207, 421

(56) References Cited

U.S. PATENT DOCUMENTS

| | | | | |
|---|---|---|---|---|
| 1,247,222 | * | 11/1917 | Cauffman | 602/74 |
| 3,741,202 | * | 6/1973 | Morgan | 602/74 |
| 3,819,177 | * | 6/1974 | Spiro | 482/122 |
| 4,570,921 | * | 2/1986 | Arnold | 482/125 |
| 4,650,182 | * | 3/1987 | Ross | 482/11 |
| 5,020,536 | * | 6/1991 | Keen | 607/109 |
| 5,031,609 | * | 7/1991 | Fye | 602/74 |
| 5,277,700 | * | 1/1994 | Smith | 602/74 |
| 5,338,290 | * | 8/1994 | Aboud | 602/74 |
| 5,419,758 | * | 5/1995 | Vijayan | 602/74 |
| 5,484,359 | * | 1/1996 | Wabafiyebazu | 482/11 |
| 5,727,254 | * | 3/1998 | Dicker | 482/105 |
| 5,816,984 | * | 10/1998 | Weiss | 482/121 |

FOREIGN PATENT DOCUMENTS

| | | | | |
|---|---|---|---|---|
| 480802 | * | 1/1938 | (GB) | 602/74 |

* cited by examiner

*Primary Examiner*—John Mulcahy
*Assistant Examiner*—Victor K. Hwang
(74) *Attorney, Agent, or Firm*—Donn K. Harms

(57) ABSTRACT

An exercise device for exercising muscles of the face, jaw and neck, featuring an elongated strap with two releasably attachable ends and an elastic portion to provide resistance for muscle exercise. A visible scale to determine the force provided by the elastic portion through the provision of indicia on the exterior surface of the elongated strap which visually shows the increasing and decreasing stretch of the elastic portion. The stretch and increasing resistance to elongation of the elastic portion may be varied by moving the position of the hook and loop or other cooperating fasteners at each end of the strap in relation to each other.

6 Claims, 2 Drawing Sheets

FACIAL EXERCISE DEVICE WITH ADJUSTMENT FOR VARIABLE RESISTANCE

This application is a continuation in Part Application to application Ser. No. 08/425,599 filed May 15, 1995, now abandoned.

BACKGROUND OF THE INVENTION

1. Field of the Invention

The present invention relates to an exercise device. More particularly to an elastic device which may be attached about the head of the user to provide a calculated resistance for isometric exercise of the muscles of the face, neck, head, and jaw. The device also features a surface mounted resistance measuring scale for the user to ascertain improvement and progress of an exercise regimen using the device. The scale also provides a measuring instrument with which the user may attach the device to the head such that a user defined amount of resistance may be provided for the exercise intended.

2. Prior Art

Isometric or resistive exercises of the muscles of the human body have long been a popular method of exercise and method of achieving a desired muscle tone of the muscles so exercised. Equipment used for isometric and similar muscle exercises ranges from simple elastic straps and chords to complicated machinery using weights and hydraulic cylinders to provide resistance.

Exercise of facial muscles is a recommended manner to help avoid or at least delay the onset of facial droop associated with aging. Further, the exercise of the facial muscles concurrently provides exercise to the supporting neck muscles and in many cases a release of the tightness and associated with stress related tension of those muscles.

However, to date, exercise of the facial, head, and neck muscles against a force of variable resistance has been especially difficult to achieve in a regimented and calculated manner. Mechanical devices for such exercise allow for resistance to the opening of the jaw muscles but are generally bulky and hard to use especially in the home.

Elastic and fabric devices which are attachable to the head or face have attempted to address the problem of proper facial and chin muscle exercise however most lack an ease of attachment and/or any method of easy user determination of the amount of resistance of the device or the progress attained using the device.

U.S. Pat. No. 5,484,359 (Wabafiyebazu) teaches an exercise device for facial muscles of the user. However it is extremely complicated to attach to the user's head. Further, Wabafiyebazu provides no easy manner to measure the resistance or progress of the user who manages to attach the device to the head.

U.S. Pat. No. 5,277,700 (Smith) teaches an adjustable facial dressing for compression and/or support of facial features for medical treatment. Smith however fails to offer any method to use the device of Smith to provide exercise nor any means to calculate the amount of resistance being provided by the device or a manner to measure improvement over time when using the device for exercise.

U.S. Pat. No. 5,419,758 (Vijayan) teaches the use of an elongated elastic band attachable to the head to compress dilated blood vessels to relieve headaches. However Vijayan does not teach any method or structure to provide an exercise regimen or a user determinable gauge of resistance provided by the device or a measurement of improvement from the use of the device.

As such, their exists a need for an easily and inexpensively manufactured apparatus which can be easily attached to the head of a user to provide a calculated variable resistance for isometric or stretching exercise by the wearer. An additional need exists for such a device that produces an easily determinable scale for the user to determine the amount of resistance desired for the individual exercise intended. A further requirement needed for such a device that also provides some scale for the user to ascertain progress toward a fitness or exercise goal in using the device. Finally, should have the additional benefit of easy attachment by the user during exercise and detachment and storage when not in use.

SUMMARY OF THE INVENTION

Applicant's device is an easily manufactured and operated exercise apparatus. It is infinitely adjustable as to resistance allowing for a user calculated amount of resistance to exercise of the facial muscles.

The device consists of an elongated elastic strap made from rubber or other elastic material and webbing or combinations thereof, and is removably attachable around the head in an infinite number of attachment points on both ends for the user to achieve desired resistance to stretching. At each of the two ends of the device a cooperating fastener is attached which is designed to communicate with and releaseably attach to the cooperating fastener attachment on the other end. Hook and loop fabric in the current best mode provides the communicating attachment at each of the two ends with the hook being mounted on one end being releasably attachable to the loop portion mounted to the other end. Hook and loop is most desirable as it will not corrode, or rust, and will not scratch the user as might be possible with other fasteners. Further, by using hook and loop fabric, the user is accorded infinite ability to adjust the tension provided by the elastic portion of the device by adjusting the tension thereon through moving the connection point between the hook and loop fasteners.

In use by a person desiring to exercise facial, head, and neck muscles, the user would place the elastic strap portion under the chin and elongate the strap around the sides of the face. The device may be constructed entirely of elastic style fabric or using a portion of elastic style fabric attached to webbing or cloth at the ends. The hook and loop fabric which is permanently attached to both ends of the device, would then be fastened in a releasable attachment of those two ends thereby securing the elongated elastic strap around the face. The elastic style fabric inherently tries to return to its original size providing sufficient tension to hold the device to the user's head with resulting frictional engagement The elastic style fabric additionally provides resistance to exercise of different face, head, chin, and neck muscles during and exercise regimen.

A scale, provided by indicia which is printed or otherwise mounted to the surface of the device or by applique of fabric, or other conventional manner of placing indicia on fabric, provides a visual scale of resistance to the user.

This visual scale is accomplished in one of two ways. First the user can ascertain the amount of stretch or elongation of the elastic style fabric is occurring during mounting on the head and thus the impending resistance for exercise, by lining up individual marks or lines of the scale with a stationary facial feature such as the top of the ear, the hair line, a skin blemish, or other user determined facial feature. When the user stretches the elastic strap around the head, the different marks of the surface mounted scale move above or below the designated stationary facial feature. Additional marks may be placed on the device at the ends for overlap of the indicia. By pulling harder or softer to stretch the elastic portion of the device, the user can visually determine the exact amount of resistance which will be provided or which might be desired for the exercise to be attempted. Should less or more resistance be desired of the elastic portion of the strap, the user can easily visually determine the increase or decrease of resistance desired and adjust the attachment of the hook and loop fabric to move the line or mark of the scale to a point where the user will see that the strap is stretched more or less to the calculated point desired to provide optimum resistance for the intended exercise.

Or, the user can visually ascertain the amount of stretch provided by the elastic fabric portion and thus the resistance being provided for the intended exercise, by lining up individual marks or marked lines of a scale on one end of the device with another scale on the other end of the device when connecting the two ends with the hook and loop fabric. When the user stretches the elastic and the strap around the head, the different marks of the surface mounted scale on the first end will move to differing positions in relation to the marks on the scale at the other end thereby visually indicating to the user the amount of force that will be provided by the device for the exercise. By pulling harder or softer to stretch the elastic strap and line up the scales positioned at each of the ends, the user can visually determine the exact amount of resistance desired for the exercise to be attempted. Should less or more resistance be desired of the elastic strap, the user can easily visually determine the increase or decrease of resistance desired and adjust the attachment of the hook and loop fabric to an infinite number of positions relative to each other to move the line or mark of the one scale to a point where the user will see that the strap is stretched more or less to the calculated point of the scale at the other end of the device.

An object of this invention is to provide an easily used apparatus for providing variable resistance to muscle movements for and during face and neck isometric exercises.

Another object of this invention is to provide an apparatus that is easily removably attached to the head of a user, prior to, during, and after, such exercise.

A further object of this invention is to provide an apparatus for providing variable exercise resistance during exercise of facial, head, and neck muscles which provides easy visual determination by the user of the amount of resistance currently being provided by the apparatus.

An additional object of the invention is to provide an apparatus for the provision of user variable resistance for isometric or resistance exercise of facial and neck muscles which may easily be adjusted by the user to a calculated amount of resistance by the user.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENTS OF THE INVENTION

Figure 1:
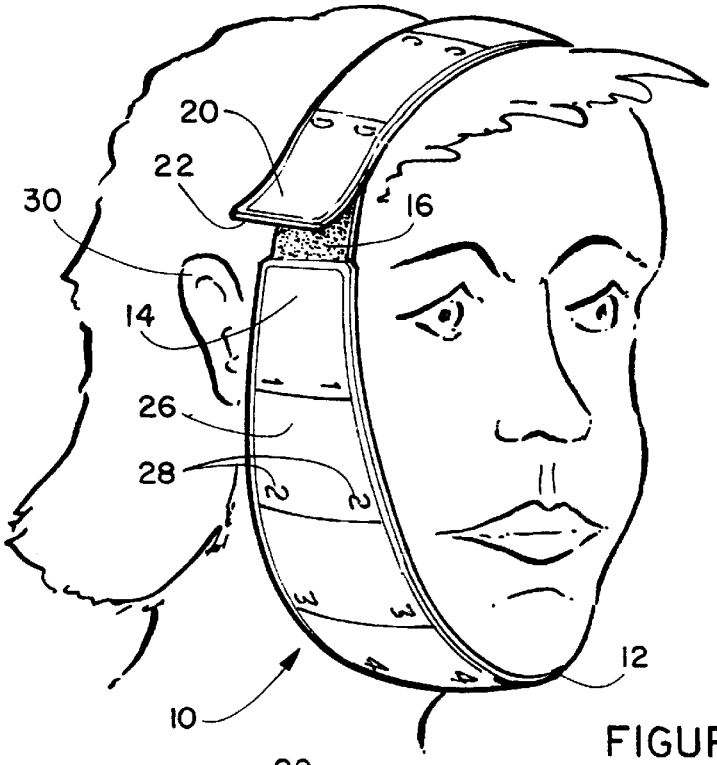
FIG. 1 is a perspective view showing the exercise device mounted upon a user's head.
Figure 2:
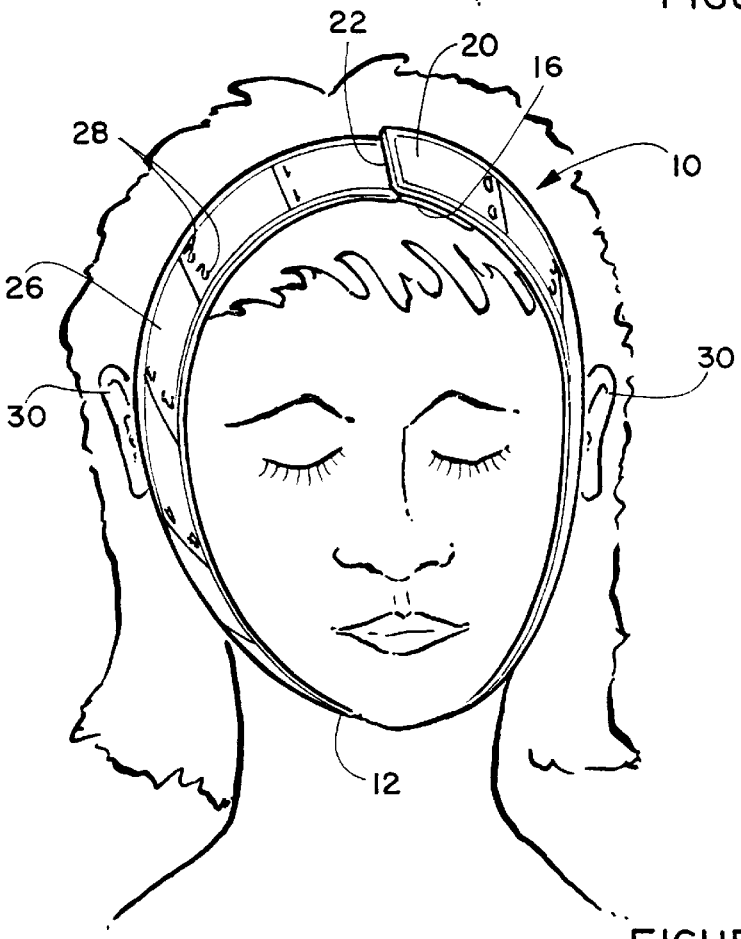
FIG. 2 is a frontal view of the exercise device mounted on a user's head.
Figure 3:
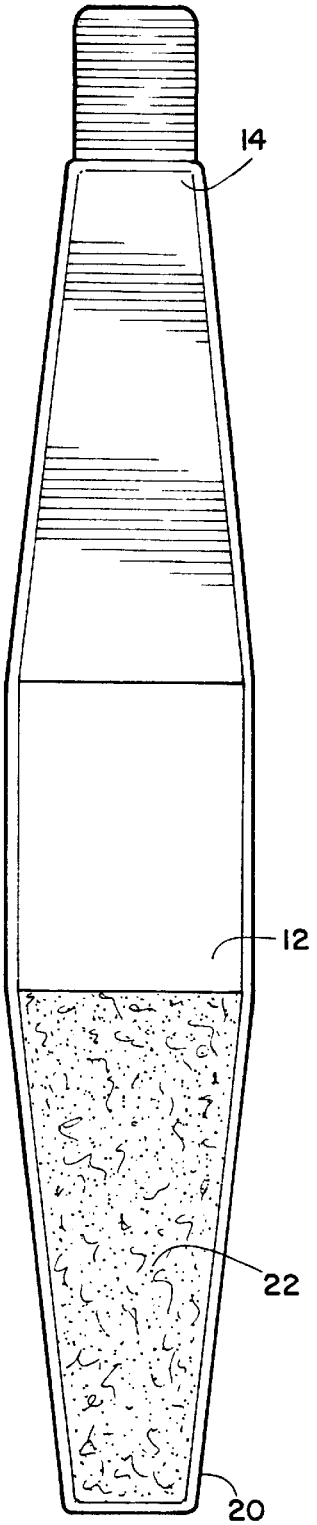
FIG. 3 is a bottom view of the applicant's facial exercise device showing the hook and loop fasteners at each end.
Figure 4:
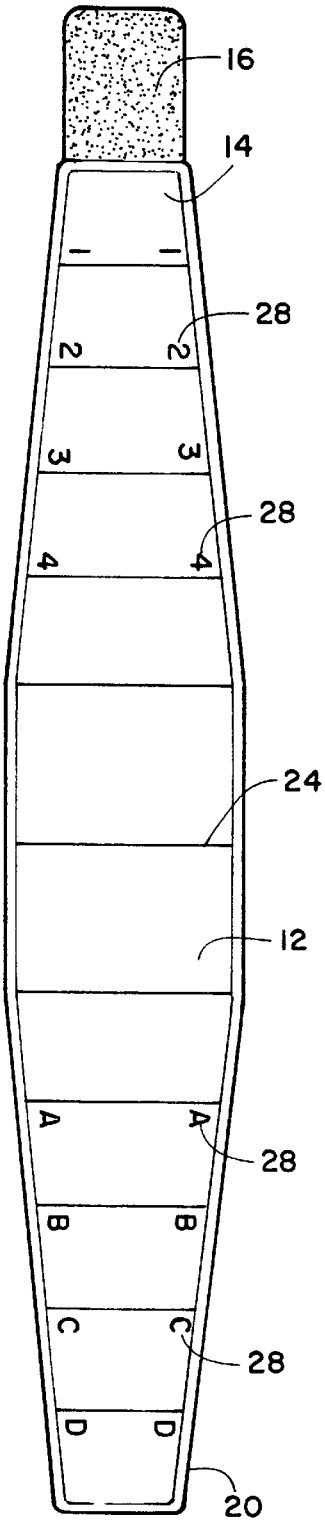
FIG. 4 is a top view of applicant's facial exercise device showing the surface mounted scales for adjustment at both ends.
Figure 5:
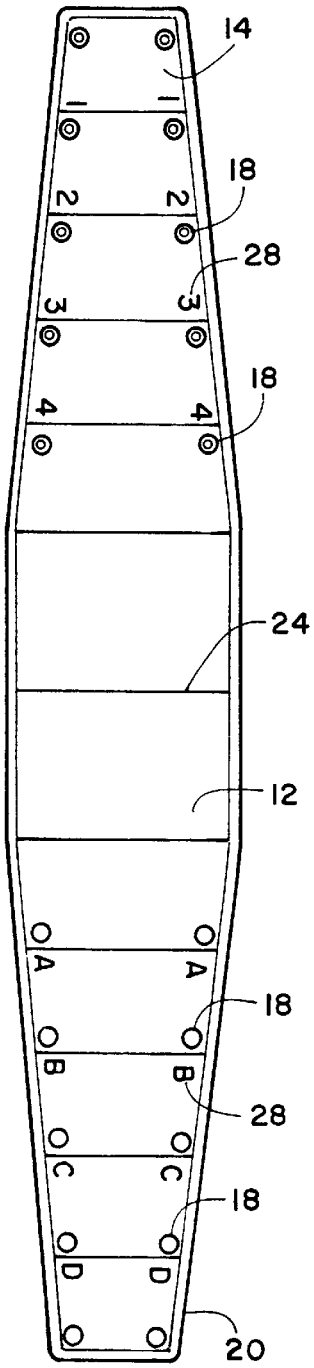
FIG. 5 is a bottom view of applicant's facial exercise device showing an alterative fastener scheme and the scales of measurement on the facial side of the device.

Referring now to the drawing Figures, specifically FIGS. 1 through 5 depicts a preferred embodiments of the invention. FIG. 1 shows applicant's elongated strap 10 exercise device for exercise of the muscles of the head, face, jaw, and upper neck, already removably mounted upon the head of a user. An elongated strap having an elastic portion 12 portion made from rubber, stretchable plastic, cloth impregnated with rubber, or other conventional elastic material providing the desired amount of resistance when stretched. The entire device 10 may be constructed of elastic, or the elastic portion 12 might just be a center section of the elongated strap 10 sewn or mounted to fabric or webbing ends in by sewing, glue, or other convectional attachment. The elastic portion 12 can be calculated to provide more or less resistance when stretched by the exercising muscles by using an elastic fabric having more or less resistance to stretching. In the case of a rubber material, thickening the material used will provide more resistance whereas making the elongated strap 12 of thinner material will provide less resistance. In the case of fabric with rubber or elastic interwoven, varying the type or elastic material or thickness will yield differing degrees of resistance to elongation. Thus, different models of the elongated strap 10 device may be manufactured using an elastic material for the elastic portion 12 with more resistance for accomplished or long time users of the elongated strap exercise device 10, or, conversely a thin rubber or elastic material of less resistance to elongation for new users or older users who may have less muscle strength to stretch the elongated strap 10 and elastic portion 12 when mounted upon the head.

At a first tapered end 14 of the elongated strap 10 a first communicating fastener 16 is mounted. The fastener in the current best mode is hook and loop style fabric 16 which would mate with and releasably attach to, cooperating hook and loop fabric 22 mounted at the second tapered end 20 of the elongated strap 10. However, in some instances other one or a combination of conventional cooperating fasteners such as the snap fasteners 18 and 24 and or hook and loop fabric could also be used to achieve a releasable cooperating attachment and thus the releasable attachment of both ends 14 and 20 of the elongated strap 10 exercise device to obtain a frictional engagement around the head of the user during use.

In use by a person desiring to exercise facial and neck muscles by opening the mouth and lowering the chin against a resistive force, the user would place the elastic portion 12 under the chin. The center of the chin would preferably be placed near the center of the elastic portion 12 so that equal amounts of resistance are provided by the elastic portion 12 during the exercise. Centering the elastic portion 12 in most instances would be done by a visual estimate of the user during mounting of the elongated strap 10 exercise device around the head. However if desired, an optional centering mark 25 can be placed on the elastic portion 12 on one or both sides to allow the user to accurately visually gauge the center of the elastic portion 12 on the center of the chin.

Such a centering insures substantially equal resistance to both sides of the face. However, if unequal resistance were desired to give more exercise to muscles on one side of the jaw, head, or neck, placing the elastic portion 12 off center would yield this option and allow for a calculated amount of differing resistance to both sides of the face and head.

In mounting the elongated strap 10 exercise device for use, the communicating fasteners of hook and loop fabric 16 and 22 in the current best embodiment, would be fastened in a releasable attachment to each other. This attachment would releaseably engage the two ends 14 and 20 of the elongated strap exercise device 10. Once so secured, with the elastic portion 12 tensioned resistance is provided for the exercise of different face, chin, and neck muscles during and exercise regimen where the user force the jaw open to elongate the elastic portion 12 overcoming the resistance provided thereby. Alternatively, as earlier noted and contemplated, other conventional fasteners such as snap fasteners 18 and 24 might be used to fasten the two ends 14 and 20 together during use. However, hook-and loop fabric currently provides the easiest manner of attachment and makes the device infinitely adjustable since the resistance provided by the elastic portion 12 due to the infinite number of cooperating mounting positions of hook and loop fabric cooperating attachment.

A visual means to determine resistance in the currently mounted position is provided by a resistance scale 26 which is formed by indicia 28 printed upon or sewn upon or otherwise mounted to the inner or outer surface of the elongated strap 10 exercise device. The resistance scale can be read and ascertained by the user in a number of ways. First, the user can ascertain the amount of elongation of the elastic portion 12 and thus the resistance being provided, by lining up individual marks or lines of the indicia 28 with a stationary facial feature such as the ear 30 or other user determined facial feature. When the user stretches the elongated strap 10 with the elastic portion 12 around the head, the different indica 28 marks of the outer surface mounted scale move above or below the designated stationary facial feature thus alerting the user to the amount of resistance to elongation of the elastic portion 12 and the resulting resistance for the exercise. By pulling harder or softer to stretch the elastic portion 12 above or below or even with a stationary facial feature, the user can visually determine the exact amount of resistance desired for the exercise to be attempted. Should less or more resistance to elongation be desired of the elastic portion 12, the user can easily visually determine the increase or decrease of resistance desired and adjust the attachment of the hook and loop fabric 16 and 22 to move the indica 28 forming the scale 26 to a point where the user will see that the strap is positioned more or less to the calculated point desired to provide optimum resistance for the exercise.

Alternately, the user can visually ascertain the amount of stretch provided by the elastic portion 12 and thus the resistance being provided for the intended exercise, by lining up individual marks or marked lines of indicia 28 positioned at both ends 14 and 20 of the elongated strap 10 thereby forming a resistance scale 28 to determine resistance being provided in the current position of the attachment of the ends. When the user stretches the elastic portion 12 and elongated strap 10 around the head, the different indica 28 marks on the surface of the first end 14 will move to differing positions in relation to indica 28 marks at the second end 20 thereby visually indicating to the user the amount of force that will be provided by the device for the exercise. Again, by pulling harder or softer to stretch the elastic portion 12 and lining up the indicia 28 positioned at each of the ends, the user can visually determine the exact amount of resistance desired for the exercise to be attempted. Should less or more resistance be desired of the elastic portion 12 , the user can easily visually determine the increase or decrease of resistance desired by adjusting the attachment of the hook and loop fabric 16 and 22 or, to a lesser extent, fasteners 18 and 24 to move the indicia 28 or mark on the first end 14 to a point to differing points of indica 28 on the second end 20 of the device.

While all of the fundamental characteristics and features of the Facial Exercise Device with Adjustment for Variable Resistance invention have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. An exercise device for exercising muscles of the face and jaw, the device comprising:

an elongated strap having a length sized and adapted to fit over the crown and under the chin of a user's head;

said elongated strap having an elastic portion, first and second tapered ends, an inner surface, and an exterior surface, said elastic portion permitting the elongated strap to be fit over the crown and under the chin of the user with a resilient tension;

each of said first and second tapered ends having complimentary releasable fasteners to selectively adjust the length of the elongated strap in contact with the user's head to effectively adjust the tension applied by the elongated strap to the user's head;

indicia on said exterior surface on both tapered ends of the elongated strap for alignment with facial features of a user when the device is worn over the crown and under the chin and providing a scale indicative of the tension applied by the elongated strap to the user's head; and a center mark indicating a midpoint of the length of the elongate strap and corresponding to a location for placing the elongate strap adjacent a user's chin when the device is worn over the crown and under the chin, wherein the device may be positioned on a user with the center mark under the chin and the first and second tapered ends releasably fastened to one another over the crown so that a user opens and closes their jaw against the resistance provided by the tensioned elongated strap to exercise the muscles of the face and jaw.

2. The device of claim 1 wherein said complimentary releasable fasteners comprises hook and loop fabric.

3. The device of claim 1 wherein said complimentary releasable fasteners comprises cooperating snap fasteners.

4. The device of claim 1 wherein said elastic portion comprises a rubber material.

5. The device of claim 1 wherein said elastic portion comprises a plastic material.

6. The device of claim 1 wherein said elastic portion comprises the entire length of the elongated strap.

* * * * *